US006032762A

United States Patent [19]

O'Donnell et al.

[11] Patent Number: 6,032,762

[45] Date of Patent: Mar. 7, 2000

[54] DOOR OPERATOR FOR ELEVATORS HAVING CURVED DOORS

[75] Inventors: Timothy P. O'Donnell, Delray Beach; Hai T. Nguyen, Deerfield Beach, both of Fla.

[73] Assignee: Vertisys International, Inc., Boca Raton, Fla.

[21] Appl. No.: 09/129,719

[22] Filed: Aug. 5, 1998

[51] Int. Cl.[7] ..... B66B 13/14

[52] U.S. Cl. ..... 187/316; 49/120

[58] Field of Search ..... 187/316, 315, 187/313, 323, 333; 49/116, 118, 120, 122

[56] References Cited

U.S. PATENT DOCUMENTS

| | | | |
|---|---|---|---|
| 1,771,601 | 7/1930 | Anderson | 49/111 |
| 1,874,562 | 8/1932 | Mariotti | 49/40 |
| 4,683,811 | 8/1987 | Huisinga et al. | 454/250 |
| 4,693,033 | 9/1987 | Tauzin | 49/122 |
| 4,785,579 | 11/1988 | Sugiyama et al. | 49/40 |
| 4,991,347 | 2/1991 | Takimoto et al. | 49/40 |
| 5,107,677 | 4/1992 | Ribaudo . | |
| 5,332,279 | 7/1994 | Golemis et al. | 296/146.4 |
| 5,377,783 | 1/1995 | Salmon et al. . | |
| 5,427,205 | 6/1995 | Saillio et al. . | |
| 5,431,251 | 7/1995 | Salmon et al. . | |
| 5,505,280 | 4/1996 | Salmon et al. . | |

*Primary Examiner*—Jonathan Salata
*Attorney, Agent, or Firm*—Brooks & Kushman P.C.

[57] ABSTRACT

An elevator door operator for positioning elevator doors along an arcuate pathway includes a linearly displaceable actuator and a pair of linkage arms, each pivotally connected to the other and connected to one end of the linearally displaceable actuator. The linkage arms are also each pivotally connected at their opposite ends to each of two support arms, each of which support arms are pivotally connected at one of their ends to each other and secured at their opposite ends, respectively to each of the door panels. The door operator may be provided as part of a door assembly which additionally includes an upper guide track comprising an elongate bar including at least two generally planar support surfaces, which guide track is mounted above the door opening to define an arcuate door travel pathway, two door panels, suspended from the upper guide track via a carriage assembly which includes a carriage frame and at least two wheels each supported by, and in rolling contact with, at least two of the support surfaces on the guide track, and a hinge pin extending from the carriage frame to pivotally connect the carriage assembly to the door panel. One embodiment operates a single door for positioning along an arcuate pathway.

5 Claims, 5 Drawing Sheets

DOOR OPERATOR FOR ELEVATORS HAVING CURVED DOORS

SUMMARY OF INVENTION

It is therefore an object of the present invention to provide a door operator for curved elevator doors which is simple in its design, and has relatively few components.

It is another object of the present invention to provide a door operator for an elevator having curved doors which employ a linkage which converts a linear displacement drive motion to angularly displace the support arms of the elevator doors where the moving elements of the drive are all displaced in the same plane.

It is yet another object of the present invention to provide a curved door operator and door system having a simple, economical, and compact linkage and carriage assembly which guide center parting curved elevator doors from their open to closed position on an arcuate pathway.

It is yet another object of the present invention to provide an operator and door assembly for arcuate doors including an improved carriage assembly and guide track which is easier to manufacture and more reliable in day-to-day operation.

It is yet another object of the present invention to provide an operator and door assembly for arcuate doors including an improved carriage assembly in which the guide wheels continuously maintain contact with the support surfaces of the guide track as the carriage moves over a curved portion of the track.

In accordance with these and other objects of the present invention an elevator door operator is provided which includes a linearly displaceable actuator and a pair of linkage arms, each pivotally connected to the other and connected to one end of the linearly displaceable actuator. The linkage arms are also each pivotally connected at their opposite ends to each of two support arms, each of which support arms are pivotally connected at one of their ends to each other and secured at their opposite ends, respectively, to each of two curved door panels. A drive motor drives the linearly displaceable actuator along a linear path from a retracted position to an extended position whereby the actuator preferably moves radially outward from the axis of rotation of the pivotally attached support arms. The pivotally attached ends of the linkages are thus also displaced along the linear pathway by the actuator. Since the other ends of the linkages are connected to the support arms of the elevator car door, the linkages are angularly displaced, and thereby also angularly displace the car door support arms.

The actuator is preferably a hydraulic door actuator which hydraulically positions a piston rod along a linear path from a retracted to an extended position. The actuator is preferably mounted so that the end of the piston rod to which the linkages are connected is moved away from the axis of rotation of the elevator car door support arms so that extension of the rod results in linear translation of the pivotally connected ends of the linkage in a direction away from the pivot point of the elevator support arms, whereby extension of the linear actuator rotates the elevator car support arms about their pivotal connecting point to close the car doors.

The door operator of the present invention is preferably provided as part of a curved door assembly which includes an upper guide track comprising an elongate bar including at least two generally planar support surfaces. The upper guide track is mounted in the elevator cab, or outside the cab in the hoistway, above the door opening and defines the arcuate door travel pathway. Two door panels, generally arcuate in cross-section, are suspended from the upper guide track via a carriage assembly which includes a carriage frame and at least two wheels each supported by, and in rolling contact with, at least two of the support surfaces on the guide track, and a hinge pin extending from the carriage frame to pivotally connect the carriage assembly to the door panel.

The upper guide track is preferably shaped to include two upper, angled, generally planar support surfaces. Each support surface preferably supports one of two wheels which are mounted on the carriage frame for rolling contact on the upper support surface, and which allow the carriage frame to extend around the sides and bottom surface of the upper guide track. The upper guide track also preferably includes a pair of lower, generally planar guide surfaces so that the upper guide track is generally diamond shaped in cross-section. The carriage frame is preferably shaped to include wheel support arms including generally planar surfaces which are suitably angled to be parallel to the lower guide surfaces to limit any movement or rocking of the carriage in the direction transverse to the pathway defined by the guide track.

The carriage also preferably includes an additional bearing surface, preferably in the form of an upthrust roller, which is mounted for rotation within the carriage frame for contacting a lower surface of the guide track generally opposite the generally flat support surfaces supporting the wheels, thereby minimizing unwanted rotation and/or movement of the carriage frame in an upward direction.

These and other objects, features, and advantages of the present invention are readily apparent from the following detailed description of the best mode for carrying out the invention when taken in connection with the accompanying drawings.

BEST MODES FOR CARRYING OUT THE INVENTION

Figure 1:
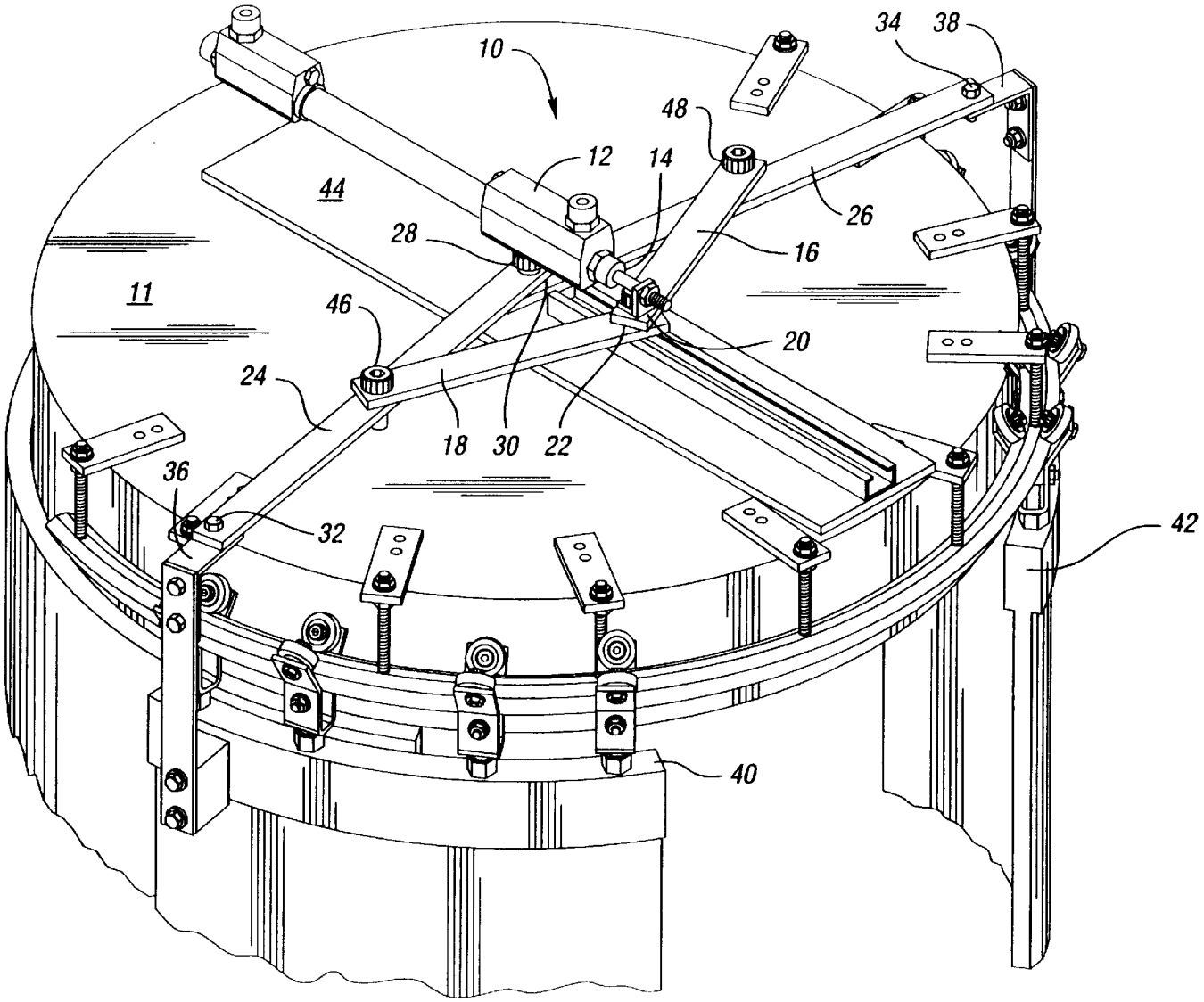
FIG. 1 is a perspective view of an elevator cab including the door operator and door assembly of the present invention.

Referring now to the drawings, FIG. 1 illustrates one embodiment of the curved door operator, generally designated as 10, of the present invention installed on a generally cylindrically-shaped elevator cab 11.

Figure 2:
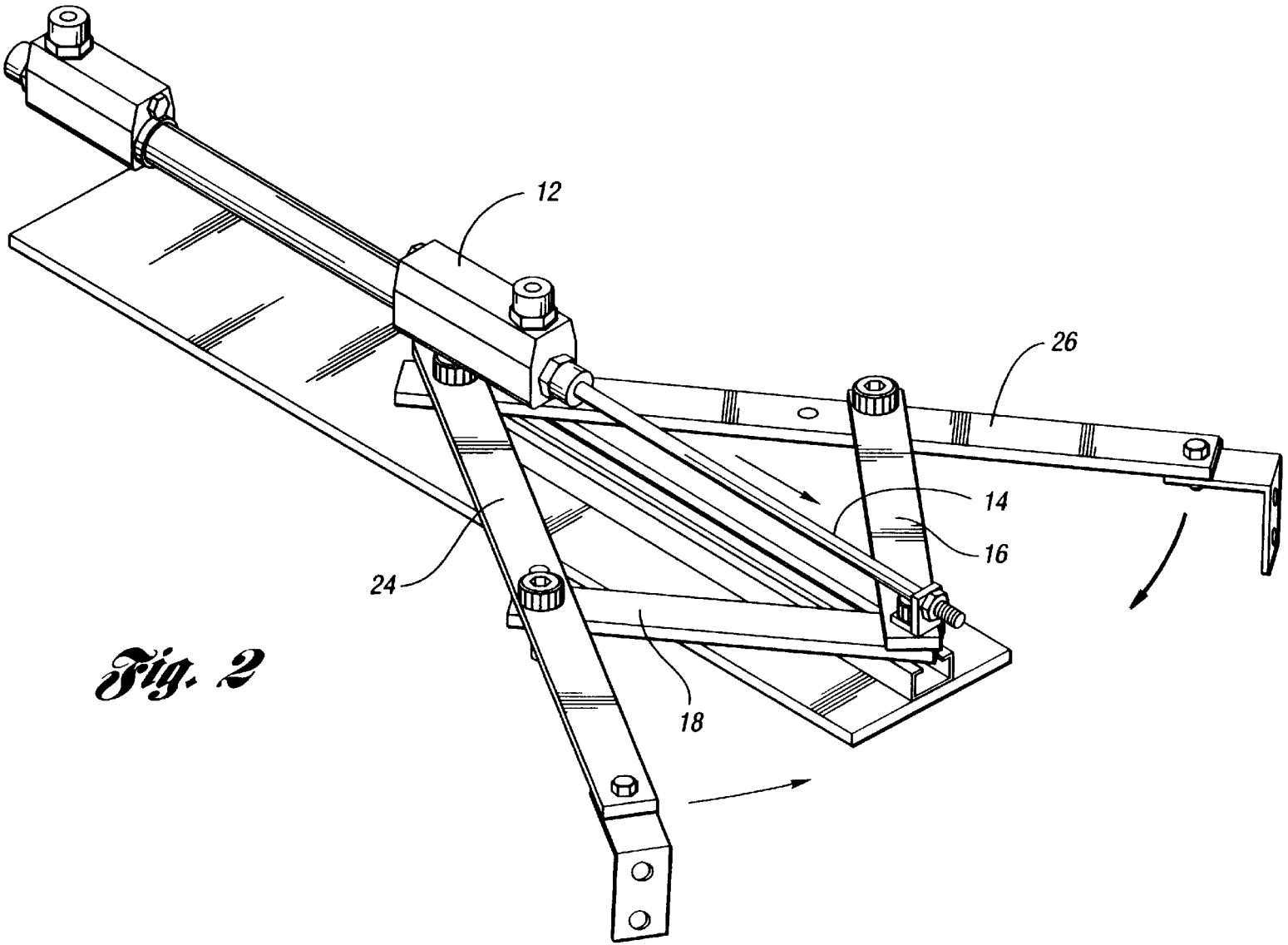
FIG. 2 is a perspective view of the operator with the linear actuator extended and the doors in the closed position.

The operator includes an actuator 12 having a linearly displaceable rod 14, and a pair of linkage arms 16 and 18 which are each pivotally connected at one of their respective ends 20 and 22 to the rod 14 so that the ends 20 and 22 of the linkage arms 16 and 18 are linearly displaced as the rod 14 is extended by operation of the actuator 12 (see FIG. 2). A pair of support arms 24,26 are each pivotally connected at one end 28,30 so that each of the support arms may be rotated about a generally vertical axis. The other ends 32,34 of the support arms are each connected, respectively, to connecting brackets 36,38 which, in turn, are connected to a pair of arcuate door panels 40,42. The pivoting ends 28,30 of the support arms are preferably mounted on a plate 44 or other similar fixture which is in turn mounted on top of the elevator cab 11.

Each linkage arm 16,18 is pivotally connected to one of the support arms 26,24 so that as the actuator linearly displaces rod 14, the ends 20,22 of the linkage arms are moved along the linear path of extension (or retraction) of the rod 14. The linear displacement of the pivotally connected ends 20,22 of the linkage arms is converted via pivotal linkages 46 and 48 into an angular displacement of the support arms 24 and 26 thereby rotating the support arms and pulling the attached door panels 40 and 42 open (upon extension of rod 14) or closed (upon retraction of rod 14) positions. It should be noted that the angle between linkage arm 16 and rod 14 (and, likewise, the angle between linkage arm 18 and rod 14) is preferably less than 90° when the rod is fully retracted.

FIG. 2 illustrates the door operator with the rod 14 in a nearly fully extended position.

Figure 7:
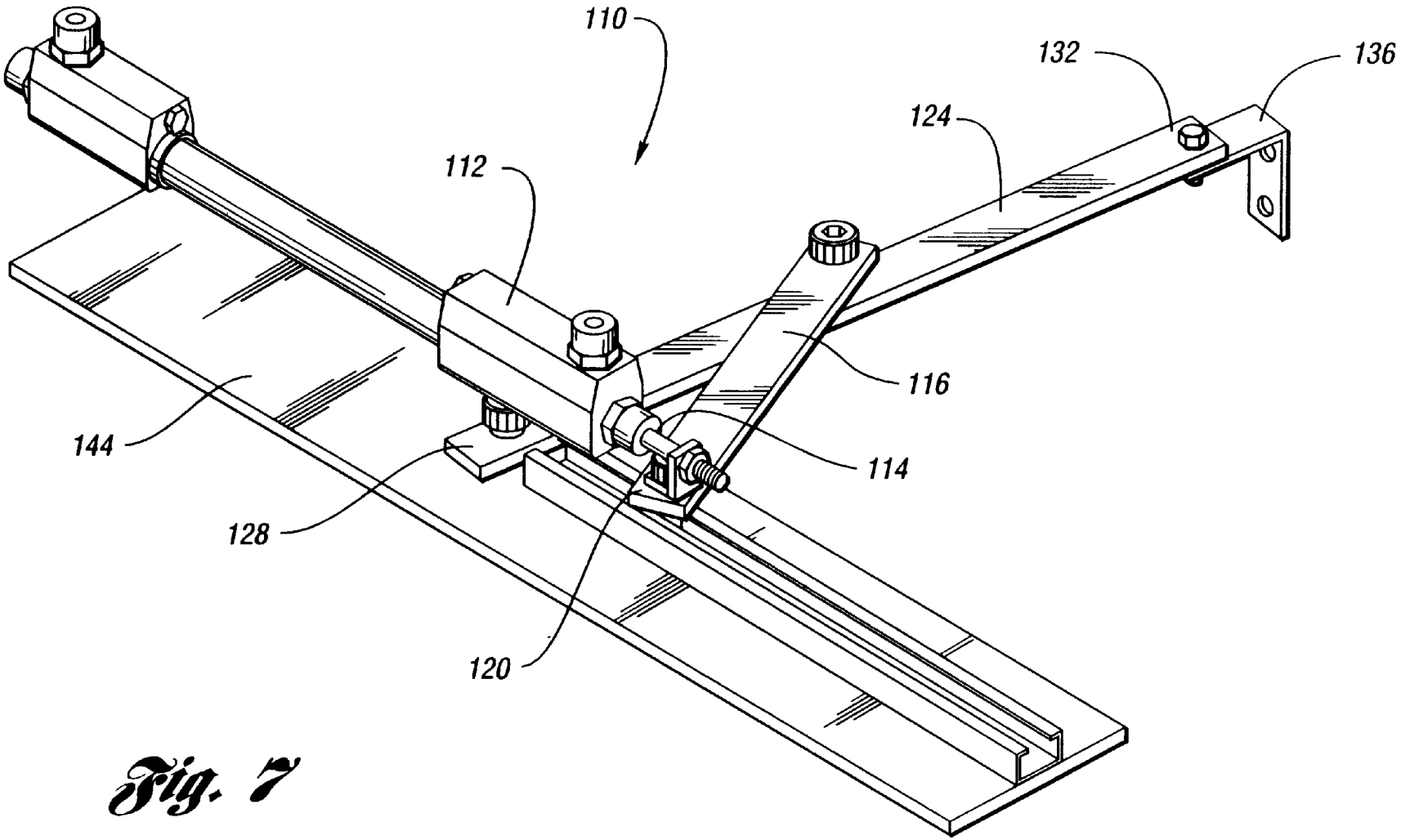
FIG. 7 is a perspective view of an alternate embodiment of the operator of the present invention for operating a left-hand side opening door configuration.

FIG. 7 illustrates an alternative embodiment of the operator which may used for side opening door configurations. In this embodiment the operator 110 includes an actuator 112 having a linearly displaceable rod 114, a linkage arm 116 which is pivotally connected at one end 120 to the rod 114 so that the linkage arm end 120 is linearly displaced as the rod 114 is extended (or retracted) by operation of the actuator 112. A support arm 124 is pivotally connected at one end 128 so that the support arm may be rotated about a generally vertical axis. The other end 132 of the support arm is connected to a connecting bracket 136 which, in turn, is connected to a door panel (not shown). Again, the pivoting end 128 of the support arm is mounted on a plate 144 or other similar fixture which is in turn mounted on the cab in the same manner as illustrated in the center parting door operator shown in FIG. 1. Thus, with minor modification the door operator of the present invention can inexpensively and efficiently operate center parting, left-side opening, or right-side opening door configurations.

The mechanical components, including the rod, linkage arms, and support arms, employed in the embodiments of FIGS. 1 and 7 are fabricated from steel. However, it will be appreciated that other materials having similar strength and durability characteristics may be substituted as desired.

It will also be appreciated that, while the illustrated embodiments are configured to rotate the support arms to close the elevator doors upon extension of the actuator rod, this configuration may be easily modified such as, for example, by repositioning the attachment point of the support rod ends 32 and 34 relative to the door panels, and repositioning the connection points of the linkage arms on the support arms, so that extension of the rod 14 causes the linkages to push rather than pull the support arms, thereby opening the center parting doors. Other variations in the positioning and arrangement of the actuator and rod, the linkage arms, and the support arms, may be implemented to achieve the desired direction and range of displacement of the elevator doors relative to the linear displacement of the actuator rod, as well as to accommodate the space requirements of the various cab designs with which the operator may be installed.

In one embodiment the linearly displaceable actuator is a hydraulic door actuator of the type disclosed in U.S. Pat. No. 5,107,677, the disclosure of which is hereby incorporated herein in its entirety. Other known actuators, including conventional electric motor drives, may be utilized in place of the hydraulic door actuator shown in the embodiments of FIGS. 1 and 7 without departing from the spirit of the present invention.

Figure 3:
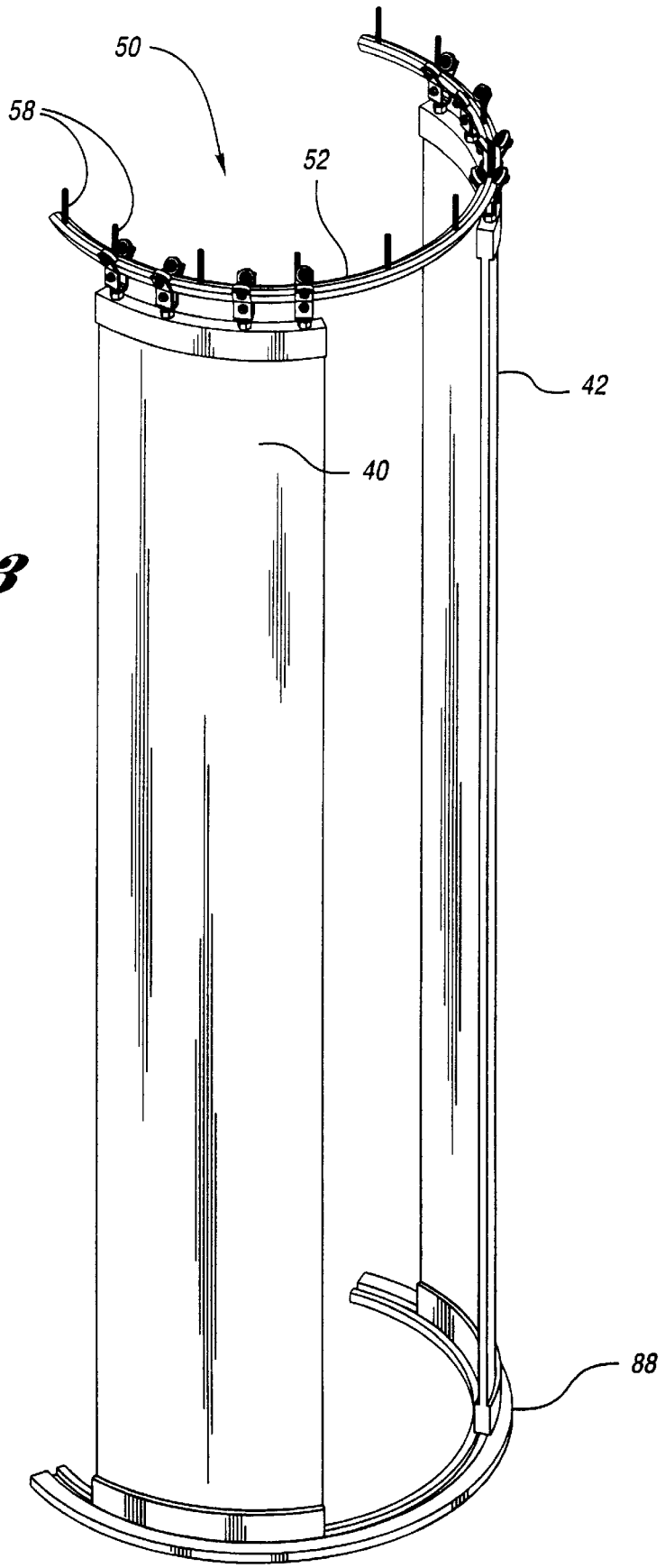
FIG. 3 is a partial perspective view of the embodiment of FIG. 1.

FIGS. 1 and 3 illustrate a door assembly which is preferably used in combination with the arcuate door operator of the present invention. The operator is preferably connected to an elevator door system of the type designated as 50, which preferably includes an upper guide track 52 comprising an elongate bar including at least two generally planar support surfaces 54,56. The upper guide track is suspended from the elevator cab (or from a wall in the hoistway when the door is installed as a hoistway door) in a suitable position to define the arcuate door opening and closing pathway. The upper guide track 52 is preferably suspended by connecting a plurality of threaded rods 58 to the top center surface 60 using a plurality of brackets 61 which are, in turn, permanently secured to the elevator cab (or secured to the hoistway walls for a hoistway door).

The upper guide track is fabricated from a strong lightweight material. In the illustrated embodiment, the upper support track is an extruded aluminum alloy, which is suspended from the elevator car (or from within the hoistway for hoistway door applications) by a plurality of commercially available threaded steel rods 58. It will be appreciated that other similarly strong and lightweight material, such as high impact plastics, may be utilized for the upper guide track.

A pair of door panels 40,42 are mounted on the upper guide track 52 as hereinafter further described to provide a center-parting arcuate door. Each door panel is suspended from the upper guide track by at least one carriage assembly 62. The carriage assembly includes a carriage frame 64 and at least two wheels 66,68 mounted thereon for rolling contact with the top support surfaces 54,56 on the upper guide track 52. The carriage assembly 62 further includes a hinge pin 70 which pivotally connects the carriage frame 64 to the door panel so that the door panel pivots relative to the carriage assembly 62 about the longitudinal axis of the hinge pin 70 as the door section moves along the curved upper guide track 52.

The door panel is preferably made of a strong, lightweight material, most preferably extruded aluminum, although suitably framed bent and tempered glass sheets, or other plastic, metal, or composite materials, may be used for the panels, depending on aesthetic considerations, as well as the nature and extent of the contemplated use of the elevator. The panel may include a carriage connector, in the form of a connector bar (not shown) which is secured to the top surface of the door panel and includes a threaded aperture suitable to accommodate the hinge pin which is mounted on, and extends downwardly from the carriage frame 64, to thereby pivotally connect the panel to the carriage frame 64.

As previously described, the upper guide track 52 preferably includes two generally upwardly facing top support surfaces 54 and 56. The top support surfaces 54 and 56 are generally planar surfaces which, when the upper guide track is suspended as shown in FIG. 3 orient each of the surfaces 54 and 56 at a slight angle from horizontal.

Figure 4:
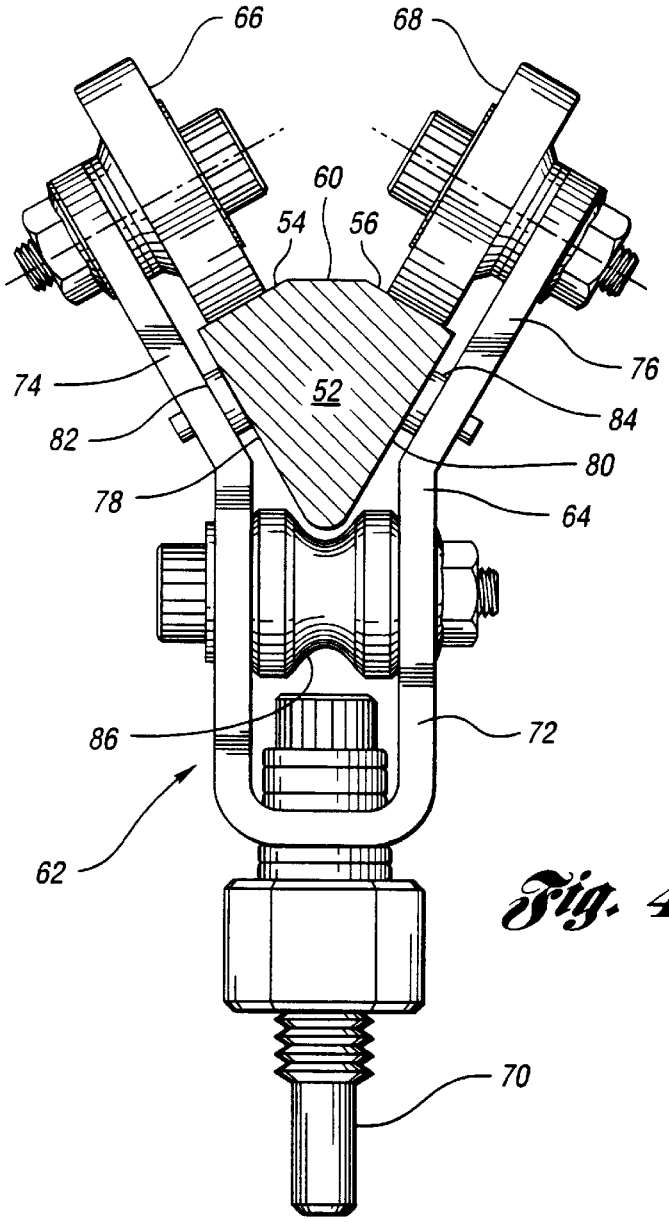
FIG. 4 is a partial perspective side view of the lower guide track.

With continuing reference to FIG. 4, the carriage frame 64 is preferably shaped to include a U-shaped base 72 and a pair of wheel support arms 74, 76 extending upward from the base 72 in a generally flared orientation to provide a mounting surface for each of the wheels 66 and 68 which is generally orthogonal to the plane of the top support surfaces 54, 56 of the upper guide track 52.

When the wheels 66 and 68 are mounted on the carriage frame arms 74 and 76 using conventional fasteners, the carriage assembly 62 may be slidably mounted on the upper guide track 52 so that the wheels are above the upper guide track in rolling contact with the angled top support surfaces 54 and 56 of the upper guide track. It has been found that the angled surfaces provide a more stable support for the doors as they move around the curved pathway defined by the upper guide track 52. The angle of the top support surfaces is preferably about 15 degrees to 60 degrees from horizontal, and most preferably about 30 degrees from horizontal. When the door panels are moved about the curved track, the wheels 66,68 tend to maintain continuous contact with the top support surfaces 54 and 56 of the upper guide track 52 to provide a smoother, more stable interaction of the carriage assembly 62 with the upper guide track 52.

The upper guide track 52 also preferably includes a pair of lower, generally planar bearing surfaces 78 and 80, each of which is generally orthogonal to the adjacent top support surfaces 54 and 56, so that the upper guide track 52 is generally diamond-shape in cross-section. The wheel mounting arms 74 and 76 are preferably flared from the base portion 72 of the carriage frame 64 so that the inside surface of each of the arms 74 and 76 are parallel, respectively, to each of the lower bearing surfaces 78 and 80. Bearing buttons 82 and 84 may also be mounted on the inside surface of each of the arms 74 and 76 of the carriage frame 64 so that the contact surfaces of the wheels 66 and 68 and the bearing surfaces 82 and 84 conform to the shape of the upper guide track 52 for a smooth, continuous contact with the guide track during operation.

An upthrust roller 86 is preferably mounted, using conventional fasteners, to extend across the opening in the U-shaped base 72 of the carriage frame 64 so that the bearing surface 68 of the upthrust roller may contact the bottom surface of the upper guide track as the carriage assembly 62 is moved along the guide track. In addition to stabilizing the carriage assembly on the guide track 52, the upthrust roller 86 provides a structural support for the carriage frame 64, thereby insuring that the frame maintains its shape, and consequently, that the arm portions 74 and 76 of the frame maintain their proper orientation with respect to the top support surfaces 54 and 56 and lower bearing surfaces 78 and 80 of the guide track for more reliable continued operation of the assembly. The upthrust roller 86 is typically fabricated from a resilient material, such as nylon, as is connected to the carriage frame 64 using conventional fasteners, such as a nut, bolt and washer, as illustrated in FIG. 4.

The wheels 66 and 68 are also preferably fabricated from nylon, although other similarly resilient materials may be utilized. These wheels are preferably fastened to the carriage frame using conventional fasteners such as the nut, bolt and washer shown in FIG. 4.

The carriage frame 64 is preferably fabricated from steel, or other material similarly suitable for this purpose.

The bearing buttons 82, 84 are preferably nylon tabs, available as part number 90136A465 from McMaster & Karr, of Atlanta, Ga.

Figure 6:
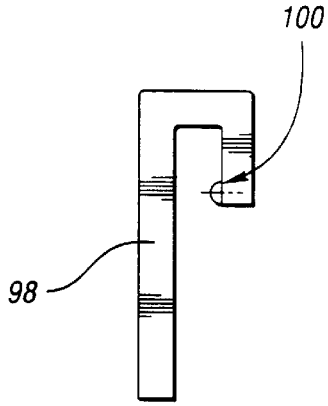
FIG. 6 is a side view of a wear strip which may be employed in the lower guide track shown in FIG. 3.
Figure 5:
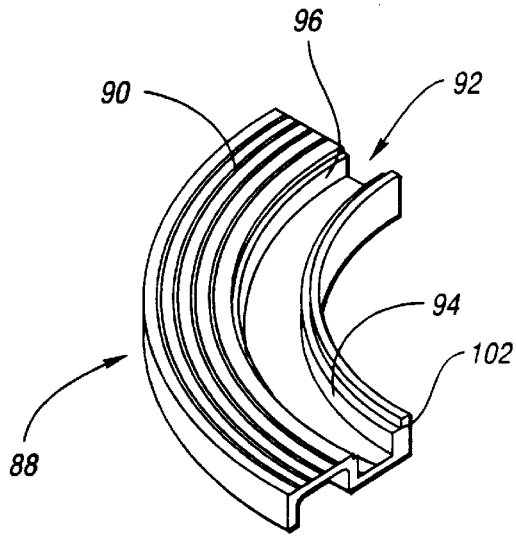
FIG. 5 is an end view of the carriage/upper guide track assembly.

FIGS. 5 and 6 illustrate further details of the lower guide track 88 illustrated in FIG. 3. The lower guide track 88 is fabricated, preferably from a resilient plastic or lightweight metal, and most preferably from extruded aluminum, to provide an upper step surface 90 and a guide slot 92 which receives a lower hinge pin and suitably sized roller bearing. The bearing preferably contacts guide surfaces 94 and 96 on the inside and outside walls of the guide slot 92, thereby guiding the lower portion of the door panels 40,42 as they are moved along the pathway defined by the upper and lower guide tracks. A portion of the guide track, illustrated in FIG. 5, is preferably also fabricated from extruded aluminum. Again, however, it will be appreciated that the lower guide track 88 may be fabricated from other resilient materials, such as molded plastic.

Referring to FIG. 6, wear strips 98, fabricated from a resilient material such as nylon, are preferably inserted into slot 92 and over the contact surfaces 94 and 96 of the lower guide track to provide for a smoother operation. These wear strips are preferably molded with a securing feature which includes dimple 100, or other similarly molded in protrusion to facilitate snap-in attachment of the wear strip 98 in the lower guide track. In the illustrated embodiment dimple 100 is of suitable size to snap fit in slot 102 which is extruded into the lower guide track for this purpose.

The door system employed with the door operator of the present invention may alternatively include a flexible door assembly having a plurality of interconnected door sections such as the type disclosed in Applicant's co-pending application Ser. No. 09/129,162, entitled "Wrap-Around Elevator Door", which application has been filed concurrently herewith. The disclosure of this "Wrap-Around Elevator Door" application is incorporated herein in its entirety.

Thus, it will be appreciated that the present invention provides a curved door operator which is simple in design, and therefore, relatively inexpensive, easy to install, and easy to maintain for curved elevator door designs It will also be appreciated that, while the illustrated embodiment employs the door operator of the present with a two panel, center-parting door configuration, the operator of the present invention may be adapted to drive other conventional elevator door system configurations in arcuate pathways.

While the best mode for carrying out the invention has been described in detail, those familiar with the art to which this invention relates will recognize various alternative designs and embodiments for practicing the invention as disclosed by the following claims.

What is claimed is:

1. An elevator door assembly for positioning an elevator door along an arcuate pathway comprising:

an actuator including an actuating rod having a first end and a second end, and wherein the second end of the actuating rod is linearly displaceable from a retracted position to an extended position;

a support arm having first and second ends, the first end of the support arm being mounted for pivotal rotation, and the second end of the support rod being connected, to a moveable elevator door panel;

a linkage arm having first and second ends, the first end of the linkage arm being pivotally connected to the second end of the actuating rod, the second end of the linkage arm being pivotally connected to the support arm;

an elongate upper guide track including at least two generally planar upper support surfaces, wherein the planes of the upper support surfaces are each at a slight angle from the horizontal plane; and at least one carriage assembly including, a carriage frame and at least two wheels each supported by, and in rolling contact with, one of the at least two support surfaces on the guide track, a hinge pin supported by the carriage frame, including a threaded portion thereon, a carriage connector mounted on the door panel and having a threaded aperture for receiving the hinge pin for pivotal connection of the door panel to the carriage assembly;

whereby the linear displacement of the actuating rod is translated via the linkage arms into an angular rotation of the support arms, thereby driving the door panels along the arcuate pathway.

2. The door assembly of claim 1 wherein the upper guide track includes at least two generally planar lower guide surfaces which are angled slightly from the vertical plane so that the upper guide track is generally diamond-shaped in cross-section; and wherein the carriage frame has a generally U-shaped base and a pair of wheel support arms extending upward from the base in a generally flared orientation, wherein each of the wheel support arms provides a mounting surface for each of two wheels which mounting surface is generally orthogonal to the plane of the top support surfaces of the upper guide track, and wherein the wheel support arms are generally parallel, respectively, to each of the lower bearing surfaces on the upper guide track.

3. The door assembly of claim 2 further including bearing buttons mounted on the inside surface of each of the wheel support arms of the carriage frame for contact with the lower support surfaces of the upper guide track during operation.

4. The door assembly of claim 2 further including an upthrust roller mounted within the U-shaped base of the carriage frame for rollably contacting the bottom surface of the upper guide track as the carriage assembly is moved along the guide track.

5. The door assembly of claim 1, further including a lower guide track including a guide slot defining at least one bearing surface, wherein the lower guide track defines the identical pathway of the upper guide track, and further including a lower hinge pin secured to and extending downwardly from the bottom surface of each door panel a distance suitable to provide for positioning of the lower hinge pin within the guide slot on the lower guide track during installation of the door assembly.

* * * * *